US011193327B2

(12) United States Patent
Zhang et al.

(10) Patent No.: US 11,193,327 B2
(45) Date of Patent: Dec. 7, 2021

(54) SPRING WINDER AND CURTAINS USING THE SPRING WINDER

(71) Applicant: Zhengzhou Mingyang Curtain Decoration Material Ltd., Zhengzhou (CN)

(72) Inventors: Nian-Qing Zhang, Zhengzhou (CN); She-Hua Wei, Zhengzhou (CN); Zhao-Xuan Sun, Zhengzhou (CN)

(73) Assignee: Zhengzhou Mingyang Curtain Accessory Materials Co., Ltd., Zhengzhou (CN)

( * ) Notice: Subject to any disclaimer, the term of this patent is extended or adjusted under 35 U.S.C. 154(b) by 90 days.

(21) Appl. No.: 16/505,124

(22) Filed: Jul. 8, 2019

(65) Prior Publication Data

US 2020/0190900 A1 Jun. 18, 2020

(30) Foreign Application Priority Data

Dec. 14, 2018 (CN) ..... 201811535119.3

(51) Int. Cl.

| | |
|---|---|
| ***E06B 9/30*** | (2006.01) |
| ***E06B 9/322*** | (2006.01) |
| ***E06B 9/262*** | (2006.01) |
| *E06B 9/323* | (2006.01) |
| *E06B 9/68* | (2006.01) |

(52) U.S. Cl.

CPC ..... *E06B 9/322* (2013.01); *E06B 9/262* (2013.01); *E06B 9/30* (2013.01); *E06B 9/323* (2013.01); *E06B 9/68* (2013.01); *E06B 2009/2625* (2013.01)

(58) Field of Classification Search

CPC .. E06B 9/322; E06B 9/262; E06B 2009/2625; E06B 9/323; E06B 2009/3222; E06B 9/42; E06B 9/58; E06B 9/68

See application file for complete search history.

(56) References Cited

U.S. PATENT DOCUMENTS

| | | | | |
|---|---|---|---|---|
| 3,809,143 A * | 5/1974 | Ipekgil | ..... | E06B 9/322 160/168.1 P |
| 7,331,370 B1 * | 2/2008 | Militello | ..... | E06B 9/322 160/170 |
| 2002/0011314 A1 * | 1/2002 | Voss | ..... | E06B 9/322 160/84.05 |

(Continued)

*Primary Examiner* — Phi D A

(74) *Attorney, Agent, or Firm* — Husch Blackwell LLP

(57) ABSTRACT

The present disclosure relates to a spring winder having a winder base, pulleys disposed at one end of the winder base, at least one constant force spring disposed on the winder base, each constant force spring having an extension end, and a guard plate is disposed at one side of the extension end of each constant force spring. A curtain using the spring winder is also described having an upper beam; a lower beam; and a curtain disposed between the upper beam and the lower beam, the upper beam having a spring winder disposed therein; a fixed plug head disposed at one end of the upper beam, a fixed pulley plug head disposed at the other end of the upper beam, each constant force spring of the spring winder being connected to the fixed plug head, a cord winding around the pulleys, the cord being connected to the pulleys at the fixed pulley plug head after being connected to the curtain.

6 Claims, 4 Drawing Sheets

(56) References Cited

U.S. PATENT DOCUMENTS

| | | | | |
|---|---|---|---|---|
| 2007/0272364 | A1* | 11/2007 | Liang | E06B 9/322 160/84.05 |
| 2008/0236764 | A1* | 10/2008 | Cheng | E06B 9/322 160/84.02 |
| 2009/0159219 | A1* | 6/2009 | Wen | E06B 9/322 160/170 |
| 2009/0173459 | A1* | 7/2009 | Hsu | E06B 9/322 160/331 |
| 2010/0206492 | A1* | 8/2010 | Shevick | E06B 9/30 160/170 |
| 2011/0247766 | A1* | 10/2011 | Hu | E06B 9/322 160/188 |
| 2011/0290429 | A1* | 12/2011 | Cheng | E06B 9/322 160/84.02 |
| 2011/0315329 | A1* | 12/2011 | Hong | E06B 9/322 160/340 |
| 2015/0033910 | A1* | 2/2015 | Steenbergen | E06B 9/307 74/99 R |
| 2016/0138330 | A1* | 5/2016 | Huang | E06B 9/322 160/170 |
| 2016/0138331 | A1* | 5/2016 | Huang | E06B 9/322 160/189 |
| 2016/0376839 | A1* | 12/2016 | Huang | E06B 9/323 160/368.1 |
| 2019/0063147 | A1* | 2/2019 | Cheng | E06B 9/322 |

* cited by examiner

SPRING WINDER AND CURTAINS USING THE SPRING WINDER

FIELD

The present invention relates to the field of curtain equipment and, more particularly, to a spring winder and curtains using the spring winder.

BACKGROUND

The existing manners of curtain retraction and release are diversified, and the commonly used are tension springs, torsion springs and constant force springs, but the elastic forces provided by tension springs and torsion springs are unstable and these springs are noisy when in operation; while constant force springs are not suitable for large curtains, and constant force springs are structurally complex and the elastic forces provided thereby are not adjustable.

Chinese Patent CN201721426648.0 entitled "A constant force rebounding mechanism and curtain using the constant force rebounding mechanism" uses a driving winding drum, a driven winding drum and a flat spring winding around the driven winding drum, wherein the driving winding drum and the driven winding drum are fixed to a gear, and all are arranged in a frame. The mechanism is not only structurally complicated, troublesome to install and inconvenient to maintain and repair, it is unable to prevent springs from being reeled off and it generates noise.

SUMMARY

The present invention aims to provide a spring winder and constant force winding system that is structurally simple and capable of preventing constant force springs from reeling off and reducing noise, and the elastic forces provided thereby can be regulated.

To this end, the present disclosure describes a spring winder having a winder base, pulleys disposed at one end of the winder base, at least one constant force spring disposed on the winder base, each constant force spring having an extension end, and a guard plate is disposed at one side of the extension end of each constant force spring.

The present disclosure further describes a curtain using the spring winder having an upper beam; a lower beam; and a curtain disposed between the upper beam and the lower beam, the upper beam having a spring winder disposed therein; a fixed plug head disposed at one end of the upper beam, a fixed pulley plug head disposed at the other end of the upper beam, each constant force spring of the spring winder being connected to the fixed plug head, a cord winding around the pulleys, the cord being connected to the pulleys at the fixed pulley plug head after being connected to the curtain.

The present invention has the following beneficial effects: The provision of guard plates at the winder base enables the constant force springs to be disposed between the guard plates, thereby restraining the springs to prevent them from being reeled off, to prevent friction of the spring winder against the inner wall of the upper beam as a result thereof, and to minimize noise. The spring winder is structurally simple, easy to install and maintain, and it enables varied provision of force by changing the number of constant force springs based on the force required.

DETAILED DESCRIPTION

Figure 1:
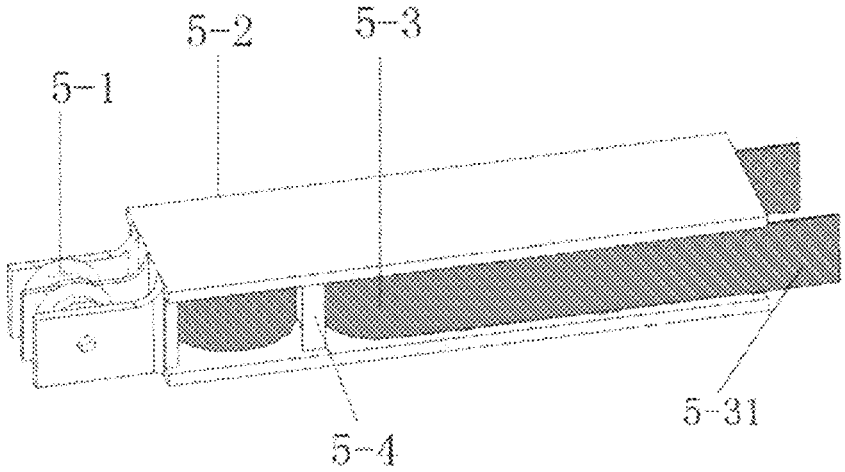
FIG. 1 is a structural schematic illustrating the exterior of a spring winder of the present invention.
Figure 2:
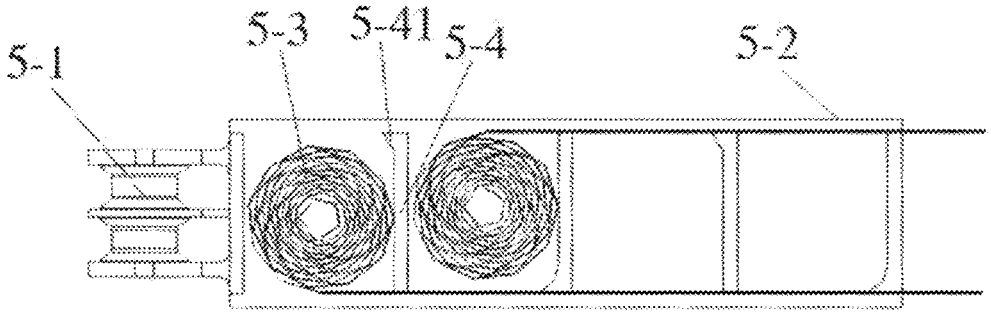
FIG. 2 is a structural schematic illustrating the interior of the spring winder of the present invention.
Figure 3:
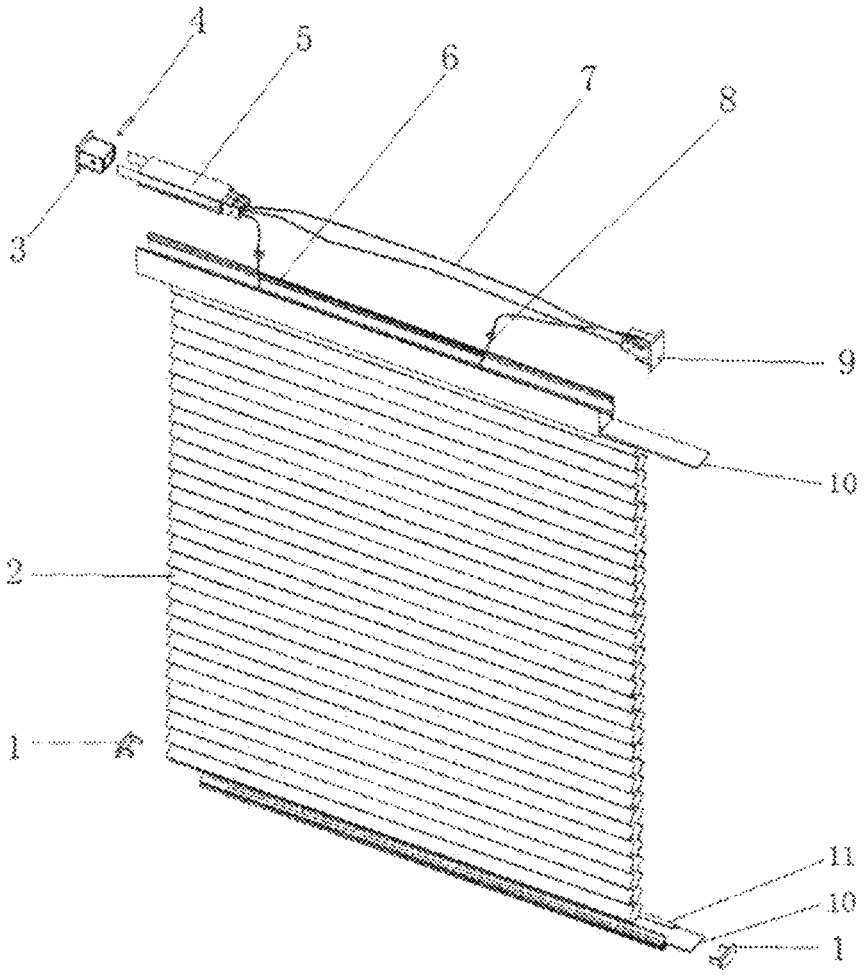
FIG. 3 is a structural schematic illustrating a curtain of the present invention.
Figure 4:
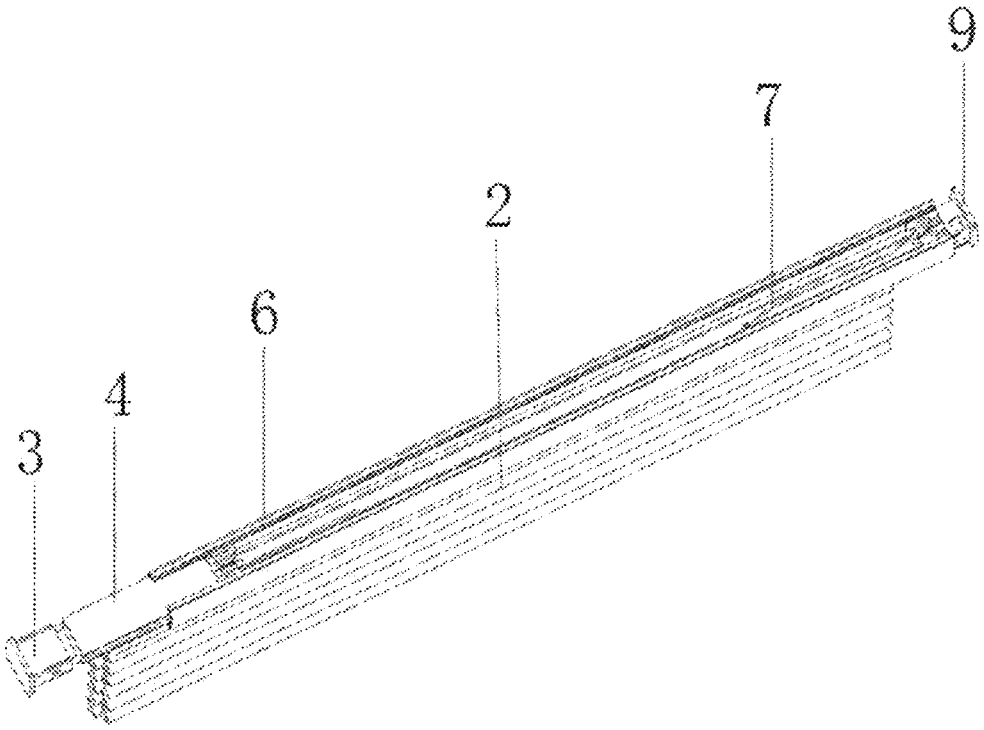
FIG. 4 is a schematic diagram illustrating the curtain of the present invention.
Figure 5:
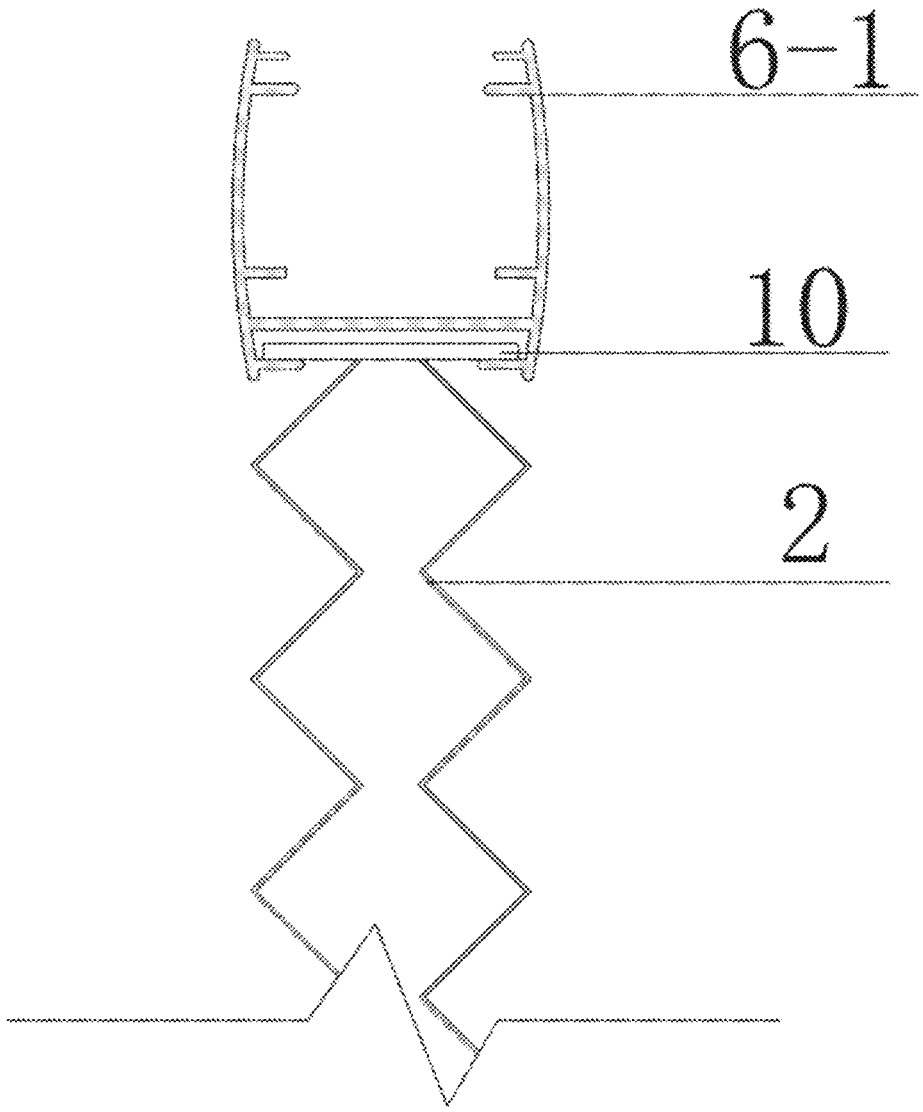
FIG. 5 is a schematic illustrating the installation of the curtain and an upper beam of the present invention.

Shown in FIGS. 1-5 is a spring winder comprising a winder base 5-2, two pulleys 5-1 disposed at one end of the winder base 5-2, a plurality of constant force springs 5-3 disposed on the winder base 5-2, a guard plate 5-4 disposed at one side of an extension end 5-31 of each of the constant force springs 5-3, the guard plate 5-4 having a bulge 5-41 disposed at one end thereof, and the number of said guard plates being at least one.

For installation, the constant force spring 5-3 at the end of the spring winder 5 is provided with a round hole and a round hole with the same diameter is also provided in a fixed plug head 3, and the constant force spring 5-3 and the fixed plug head 3 can be fixed using a steel spindle 4 (or any other type of pin). The installation is simple and low-cost. One end of each of the constant force springs is fixed, and the constant force springs are stretched and flatly spread within the rail.

Based on the forces required by different curtain systems, the number of constant force springs used in the spring winder of the present invention may be increased or reduced, or the specifications (or materials) thereof may be changed, and different winder bases may also be provided based on different curtain systems. The constant force springs are symmetrically arranged to ensure equilibrium of the pulling force provided.

The guard plates 5-4 not only prevent the constant force springs 5-3 from falling off and locate them, and as retraction of the constant force springs often causes reeling off and loud noise, the design of the guard plates 5-4 is such that it prevents the constant force springs 5-3 from reeling off and effectively prevent friction between the spring winder 5 and the rail 6-1 and thereby reduces noise. The position height of the guard plates 5-4 that is slightly lower than the winder base 5-2 also effectively prevents the constant force springs 5-3 from being jammed between the rail 6-1 and the winder base 5-2.

A curtain using the spring winder of the present invention comprises: an upper beam 6; a lower beam 11; and a curtain 2 disposed between the upper beam 6 and the lower beam 11; the upper beam 6 being provided with a spring winder 5 disposed therein, a fixed plug head 3 disposed at one end of the upper beam 6 and a fixed pulley plug head 9 disposed at the other end thereof; a constant force spring 5-3 of the spring winder 5 being connected to the fixed plug head 3; a cord 7 winding around a pulley 5-1 with the cord 7 connected to a fixed pulley of the fixed pulley plug head 9 after being connected to the curtain 2; a rail 6-1 disposed in the upper beam 6 with the spring winder 5 disposed the rail 6-1; counterweight blocks disposed in the lower beam 11; and two lower beam plug heads 1 disposed at the ends of the lower beam 11.

Force transmission in the entire curtain system is carried out by the cord to achieve equilibrium of the entire curtain system, and the force required by the entire system is provided by the spring winder. The constant force spring at the end of the spring winder 5 is fixed to the fixed plug head 3 by means of a steel spindle 4, and two pulleys at the front end of the spring winder 5 are connected to the entire curtain through a cord 7 and eventually connected to two pulleys of the fixed pulley plug head 9. The curtain 2 is made to penetrate into the upper beam 6 and the lower beam 11 by depression bars 10 at both ends thereof. The curtain is made to move downwards when the cord 7 is pulled causing the spring winder 5 to slide in the rail 6-1, with the spring winder 5 providing a traction force. Due to the constraint of the rail when the number of constant force springs is one, the leaning the extension end of the constant force spring against the rail wall enables the spring winder to slide so that the curtain can be static at any position. The provision of an air drain 8 serves to minimize damage of the cord 7 during its movement in the rail 6-1.

When in operation, the cord 7 has a fixed length and is threaded in a manner such that the fixed pulley plug head 9 is fixed to one end of the rail 6-1 when the curtain is moving downwards, so that the cord 7 generates a traction force with respect to the spring winder 5. The end of the constant force spring in the spring winder 5 is fixed together with the fixed plug head 3 and when the cord 7 generates a traction force with respect to the spring winder 5, the spring winder 5 slides in the rail 6-1 and causes the extension of the constant force spring to generate a stable opposite reactive force. Suitable counterweights may be added to the lower beam 11 of the curtain system at the beginning such that the force provided by the winder is equal to the self weight of the curtain, so that the curtain is always static. An external force is added to cause the curtain to lower or retract, and the curtain can be static at any position when the external force is removed.

The foregoing merely describes preferred embodiments of the present invention, and it should be noted that any alterations and modifications made by persons skilled in the art without departing from the spirit and principles of the present invention shall fall within the scope of protection thereof.

What is claimed is:

1. A spring winder for a window curtain, comprising:

a winder base;

first and second pulleys fixedly connected to the winder base at a first end of the winder base;

at least one constant force spring disposed on the winder base, the constant force spring having an extension end;

a guard plate disposed vertically within the winder base at one side of the extension end of the constant force spring; and a fixed plug head facing a second end of the winder base opposite the first and second pulleys, wherein the extension end of the spring is connected to the fixed plug head and wherein the winder base, together with the first and second pulleys, is slidable relative to the fixed plug head.

2. A spring winder for a window curtain as defined in claim 1, characterized in that the guard plate is provided with a bulge disposed at one end thereof.

3. A spring winder for a window curtain as defined in claim 2, characterized in that the number of said guard plates is at least one.

4. A window curtain, comprising:

an upper beam;

a lower beam; and a curtain disposed between the upper beam and the lower beam;

the upper beam having a spring winder disposed therein the spring winder further comprising:

a winder base;

first and second pulleys fixedly connected to the winder hasp at a first end of the winder base, at least one constant force spring disposed on the winder base, the constant force spring having an extension end, wherein the extension end extends out of said winder base during extension of the constant force spring; and a guard plate disposed vertically within the winder base at one side of the extension end of the constant force spring;

a fixed plug head disposed at one end of the upper beam and facing a second end of the winder base opposite the first and second pulleys;

a fixed pulley plug head disposed at the other end of the upper beam;

wherein the extension end of the constant force spring is connected to the fixed plug head;

wherein the winder base, together with the first and second pulleys, is slidable relative to the fixed plug head, and a cord winding around the first and second pulleys, the cord being connected with the first and second pulleys at the fixed pulley plug head after being connected to the curtain.

5. A window curtain as defined in claim 4, characterized in that the upper beam is provided with a rail disposed therein with the spring winder disposed in the rail.

6. A window curtain as defined in claim 4, characterized in that the lower beam is provided with plug heads disposed at both ends thereof.

* * * * *